US009079190B2

(12) United States Patent
Wang et al.

(10) Patent No.: US 9,079,190 B2
(45) Date of Patent: Jul. 14, 2015

(54) VERTICAL RING HIGH GRADIENT MAGNETIC SEPARATOR

(75) Inventors: Zhaolian Wang, Weifang (CN); Yuzhou Zhou, Weifang (CN); Hongli Jia, Weifang (CN); Fengliang Liu, Wefang (CN); Liangliang Zeng, Weifang (CN); Shichang Liu, Weifang (CN)

(73) Assignee: Shandong Huate Magnet Technology Co., Ltd., Shandong (CN)

( * ) Notice: Subject to any disclaimer, the term of this patent is extended or adjusted under 35 U.S.C. 154(b) by 0 days.

(21) Appl. No.: 13/579,850

(22) PCT Filed: Nov. 21, 2011

(86) PCT No.: PCT/CN2011/082524

§ 371 (c)(1),
(2), (4) Date: Aug. 17, 2012

(87) PCT Pub. No.: WO2013/023416

PCT Pub. Date: Feb. 21, 2013

(65) Prior Publication Data

US 2014/0224711 A1 Aug. 14, 2014

(30) Foreign Application Priority Data

Aug. 15, 2011 (CN) ..... 2011 1 0233277
Aug. 15, 2011 (CN) ..... 2011 2 0295548 U

(51) Int. Cl.
*B03C 1/00* (2006.01)
*B03C 1/025* (2006.01)
(Continued)

(52) U.S. Cl.
CPC ..... *B03C 1/025* (2013.01); *B03C 1/0335* (2013.01); *B03C 1/0337* (2013.01); *B03C 1/14* (2013.01); *B03C 2201/18* (2013.01)

(58) Field of Classification Search
USPC ..... 209/213; 336/62, 223; 29/593
See application file for complete search history.

(56) References Cited

U.S. PATENT DOCUMENTS 3,060,073 A * 10/1962 Horn ..... 156/171
3,593,242 A * 7/1971 Andersson et al. ..... 336/62
(Continued)

FOREIGN PATENT DOCUMENTS

CN 2885422 4/2007
CN 201220185 * 6/2008
(Continued)

OTHER PUBLICATIONS

International Search Report dated May 17, 2012 corresponding to International Patent Application No. PCT/CN2011/082524.
(Continued)

*Primary Examiner* — Terrell Matthews
(74) *Attorney, Agent, or Firm* — Ohlandt, Greeley, Ruggiero & Perle, LLP

(57) ABSTRACT

A vertical ring high gradient magnetic separator comprises an exciting winding coil and a coil casing, wherein the winding coil is immerged in coolant in the coil casing, the winding coil is of a multi-layer structure, and an insulating member is provided between each layer or a plurality of layers of the winding coil to form gaps through which the coolant passes. The winding coil of the vertical ring high gradient magnetic separator has a rapid heat dissipation capability in the coolant, which can ensure the winding coil maintaining a lower temperature during operation, thereby obtaining a higher magnetic field strength.

9 Claims, 6 Drawing Sheets

(51) Int. Cl.
*B03C 1/033* (2006.01)
*B03C 1/14* (2006.01)

(56) References Cited

U.S. PATENT DOCUMENTS

| | | | | | |
|---|---|---|---|---|---|
| 3,668,588 | A * | 6/1972 | Walsh, Jr. | ..... | 336/192 |
| 3,939,449 | A * | 2/1976 | Boyd et al. | ..... | 336/60 |
| 4,035,678 | A * | 7/1977 | Lambrecht et al. | ..... | 310/52 |
| 4,505,824 | A | 3/1985 | Akamine et al. | | |
| 6,411,188 | B1 * | 6/2002 | Pruess et al. | ..... | 336/96 |
| 7,364,921 | B1 * | 4/2008 | Sciorra et al. | ..... | 436/526 |
| 2014/0224711 | A1 * | 8/2014 | Wang et al. | ..... | 209/213 |

FOREIGN PATENT DOCUMENTS

| | | | |
|---|---|---|---|
| CN | 201220185 | | 4/2009 |
| CN | 201275499 | | 7/2009 |
| CN | 201437098 | | 4/2010 |
| CN | 201441946 | U | 4/2010 |
| CN | 201516376 | | 6/2010 |
| CN | 101786041 | A | 7/2010 |
| CN | 101786042 | | 7/2010 |
| CN | 101912816 | A | 12/2010 |
| CN | 202207627 | U | 5/2012 |
| DE | 8414955 | U1 | 6/1985 |
| JP | 2010042367 | | 2/2010 |
| SU | 1553174 | A2 | 3/1990 |
| SU | 1639749 | A1 | 4/1991 |
| SU | 1799628 | A1 | 3/1993 |
| WO | WO 2011103803 | A1 * | 9/2011 |

OTHER PUBLICATIONS

Russian Office Action dated Sep. 12, 2013 corresponding to Russian App. No. 2012137880 with English translation, 10 pp.
English translation of European Patent Office dated Nov. 6, 2013 corresponding to European Application No. 11861900.6, 9 pp.
First Office Action issued by the State Intellectual Property Office (SIPO) of the People's Republic of China issued on Oct. 30, 2012 for Application No. 201110233277.5, 8 pages.

* cited by examiner

VERTICAL RING HIGH GRADIENT MAGNETIC SEPARATOR

CROSS-REFERENCED APPLICATIONS

The present application is the national phase of International Application No. PCT/CN2011/082524, titled "VERTICAL RING HIGH GRADIENT MAGNETIC SEPARATOR", filed on Nov. 21, 2011, which claims the benefit of priority to Chinese Patent Application No. 201110233277.5 titled "VERTICAL RING HIGH GRADIENT MAGNETIC SEPARATOR", filed with the Chinese State Intellectual Property Office on Aug. 15, 2011, and Chinese Patent Application No. 201120295548.5 titled "VERTICAL RING HIGH GRADIENT MAGNETIC SEPARATOR AND COOLING APPARATUS THEREOF", filed with the Chinese State Intellectual Property Office on Aug. 15, 2011, the entire disclosure of all are incorporated herein by reference.

BACKGROUND

1. Field of the Disclosure

The present application relates to the technical field of mineral separation equipment, and particularly to a vertical ring high gradient magnetic separator.

2. Discussion of the Background Art

One of the conventional main methods for wet separating weak magnetic minerals is to separate materials by using a vertical ring high gradient magnetic separator.

The vertical ring high gradient magnetic separator is a kind of device for wet separating weak magnetic minerals using a higher magnetic field generated by a cooled winding coil having a lower temperature. The separation principle of the vertical ring high gradient magnetic separator is as follows: the magnetic field generated by the winding coil passes through upper and lower magnetic yokes to form a magnetic circuit; a rotary ring mounted with a magnetic medium is provided in a space between the upper and lower magnetic yokes and the winding coil. A lower part of the rotary ring is immerged in ore slurry, and along with the rotation of the rotary ring, the magnetized medium absorbs magnetic mineral particles onto a surface of the magnetic medium.

After the rotary ring brings the magnetic medium immerged in the ore slurry to leave the ore slurry and rotates by a certain angle, pressure water provided at the top of the rotary ring flushes the magnetic mineral particles into a concentrate collection apparatus to achieve the separation of materials.

A higher magnetic field is required to realize the separation of the weak magnetic minerals and many associated minerals, and the magnetic field is mainly generated by the winding coil. From a technical perspective, when the winding coil has same parameters, such as the number of turns, wire diameter, material, current, voltage, the higher the temperature rise of the coil is, the greater the wire resistance is, and the greater the thermal decay of the magnetic field is, and also the insulation of the coil declines gradually.

At present, the cooling way of the vertical ring high gradient coil mainly includes an inner-cooling way and an external-cooling way.

The inner-cooling way uses a copper hollow conducting wire, and cooling water is introduced into the conducting wire to take away heat. Since the water contains some impurities, during a long-term using process, the cooling water is easy to form limescale to block the hole of the coil, thereby causing a high failure rate. In addition, the cooling water after being used drains away directly, which causes a serious waste of water resources, and there are also other disadvantages, such as high consumption of copper, high cost and complicated process.

In the external-cooling way, the coil is immerged in cooling oil, the cooling oil circulates outside the winding coil to dissipate heat by a cooling apparatus in the circulation circuit. The cooling effect of this cooling way mainly depends on two aspects: the capability of the cooling oil of taking away the heat of the winding coil timely, and the capability of the cooling apparatus of dissipating heat of the cooling oil. As for the first aspect, the existing formed winding coil generally forms an compact unity, and only the external of the winding coil can in contact with the cooling oil directly, therefore, the cooling oil can only take away the heat at the outer surface of the winding coil timely, and the heat generated inside the winding coil can only be transferred to the external of the winding coil first and then is transferred to the cooling oil. Due to the restriction of heat conduction efficiency, a lot of heat may accumulated inside the winding coil and can not be dissipated, thereby causing the rise of the overall temperature of the winding coil and reduction of the magnetic field strength.

Therefore, a technical problem to be solved by those skilled in the art is to improve the heat dissipation capability of the winding coil of the vertical ring high gradient magnetic separator in the coolant so as to ensure the winding coil maintaining a lower temperature during operation, thereby obtaining a higher magnetic field strength.

SUMMARY

An object of the present application is to provide a vertical ring high gradient magnetic separator. A winding coil of the vertical ring high gradient magnetic separator has a rapid heat dissipation capability in coolant, which ensures the winding coil maintaining a lower temperature during operation, thereby obtaining a higher magnetic field strength.

For realizing the above object, the present application provides a vertical ring high gradient magnetic separator including an exciting winding coil and a coil casing, wherein the winding coil is immerged in coolant in the coil casing and the winding coil is of a multi-layer structure, and an insulating member is provided between each layer or a plurality of layers of the winding coil to form gaps through which the coolant passes.

Preferably, the insulating member includes first insulating pad strips located between each layer or a plurality of layers of the winding coil, which are arranged inclinedly with respect to a flow direction of the coolant and are spaced apart from each other.

Preferably, second insulating pad strips are further provided for connecting the first insulating pad strips, the second insulating pad strips are arranged intersecting with the first insulating pad strips and are embedded in notches of the first insulating pad strips.

Preferably, the second insulating pad strips are arranged along the flow direction of the coolant, and each have a thickness less than or equal to a depth of each of the notches of the first insulating pad strips.

Preferably, the first insulating pad strips are of a double-layer structure or a multi-layer structure, wherein a layer, intersecting with the second insulating pad strips, of each of the first insulating pad strips is of a multi-segment structure, and a space between adjacent segments of the layer forms each of the notches.

Preferably, third insulating pad strips are vertically provided between an inner side of the winding coil and an annular inner wall of the coil casing and are spaced apart from each other, and liquid guiding notches spaced apart from each other are provided on a side, close to the annular inner wall, of each of the third insulating pad strips.

Preferably, the third insulating pad strips are fixed to the annular inner wall.

Preferably, a liquid inlet and a liquid outlet of the coil casing are located at two ends of the coil casing respectively.

Preferably, a liquid inlet and a liquid outlet of the coil casing are located at a same end of the coil casing, and a baffle is provided inside the coil casing for separating the liquid inlet from the liquid outlet.

Preferably, a liquid compensating tank in communication with the coil casing is mounted at an upper portion of the coil casing and a moisture-proof breather is mounted at an air inlet of the liquid compensating tank.

The vertical ring high gradient magnetic separator provided by the present application makes further improvements on the basis of the prior art. The winding coil of the vertical ring high gradient magnetic separator is of a multi-layer structure, and an insulating member is provided between each layer or a plurality of layers of the winding coil to form gaps through which the coolant can pass. In this way, after entering into the coil casing via the liquid inlet during operation, the coolant may flow between each layer or a plurality of layers of the winding coil, so that the contact area between the coolant and the winding coil multiplies, the coolant may be in contact with the winding coil at different positions sufficiently to exchange heat, and then the coolant carrying the heat flows toward the liquid outlet along the gaps so as to take away the heat generated by the winding coil, this rapid heat dissipation capability can ensure the winding coil maintaining a lower temperature during operation, thereby obtaining a higher magnetic field strength.

In an embodiment, the insulating member includes first insulating pad strips, and first insulating pad strips between each layer or a plurality of layers of the winding coil are arranged inclinedly with respect to the flow direction of the coolant and are spaced apart from each other. Since the first insulating pad strips are arranged inclinedly with respect to the flow direction of the coolant and are spaced apart from each other, a plurality of relatively independent coolant channels may be formed between each layer or a plurality of layers of the winding coil, such that the coolant can flow through the winding coil along the channels without generating turbulent flow. In addition, the inclined arrangement can reduce the resistance for the coolant on one hand, such that the coolant can flow through the winding coil smoothly, and can obtain a longer channel length on the other hand, such that the coolant and the winding coil may be in contact with each other sufficiently to exchange heat.

In another embodiment, third insulating pad strips are vertically provided between the inner side of the winding coil and the annular inner wall of the coil casing and are spaced apart from each other, and liquid guiding notches spaced apart from each other are provided on a side, close to the annular inner wall, of each of the third insulating pad strips. In this way, the coolant enters into a liquid inletting chamber of the coil casing via the liquid inlet, then flows inclinedly along the gaps of the winding coil, and then may flow to an oil returning chamber smoothly via the liquid guiding notches of the third insulating pad strips.

Figure 1:
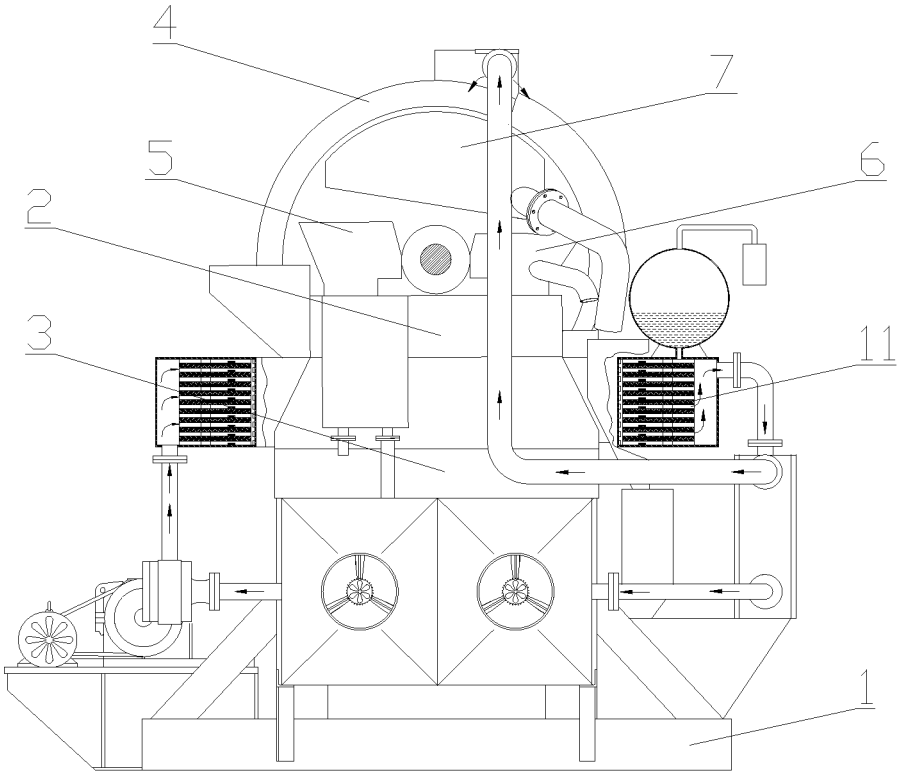
FIG. 1 is a partial sectional view of a vertical ring high gradient magnetic separator according to an embodiment of the present application, wherein arrows in the figure indicate a flow direction of cooling oil and a flow direction of the ore-flushing water respectively.

Reference numerals in FIGS. 1 to 11:

| | |
|---|---|
| 1. machine frame | 2. upper magnetic yoke |
| 3. lower magnetic yoke | 4. rotary ring |
| 5. ore feeding bucket | 6. water flushing bucket |
| 7. concentrate collection apparatus | 8. medium box |
| 9. tailings box | 10. pulsating box |
| 11. winding coil | 12. coil casing |
| 12-1. oil inlet | 12-2. oil outlet |
| 13-1. first insulating pad strip | 13-2. second insulating pad stripe |
| 13-3. third insulating pad strip | 13-3-1. liquid guiding notches |
| 14. baffle | 15. oil compensating tank |
| 16. breather | |

DETAILED DESCRIPTION OF THE PREFERRED EMBODIMENTS

The object of the present application is to provide a vertical ring high gradient magnetic separator. A winding coil of the vertical ring high gradient magnetic separator has a rapid heat dissipation capability in coolant, which ensures the winding coil maintaining a lower temperature during operation, thereby obtaining a higher magnetic field strength.

For those skilled in the art to better understand technical solutions of the present application, the present application is further described in detail below in conjunction with accompanying drawings and embodiments.

Terms indicating the directions and positions, such as "up, down, left and right", are based on the position relationship of the drawings, should not be interpreted as absolute limitation to the protection scope of the present application. Similarly, terms "first" and "second" herein are only used to facilitate describing, to distinguish different components having the same name, and are not intended to indicate the order or the primary or secondary relationship.

Figure 2:
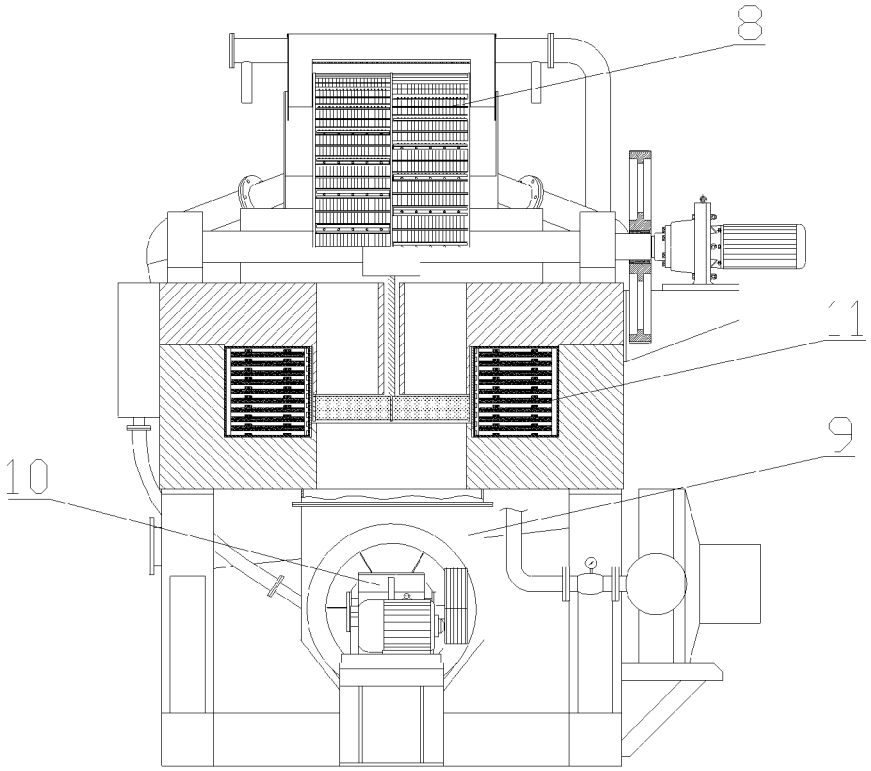
FIG. 2 is a left view of the vertical ring high gradient magnetic separator in FIG. 1, wherein the part of a winding coil is a sectional view.

Reference is made to FIGS. 1 and 2. FIG. 1 is a partial sectional view of a vertical ring high gradient magnetic separator according to an embodiment of the present application, wherein arrows in the figure indicate a flow direction of cooling oil and a flow direction of the ore-flushing water respectively; and FIG. 2 is a left view of the vertical ring high gradient magnetic separator in FIG. 1, wherein the part of a winding coil is a sectional view.

In an embodiment, a machine frame 1 is provided in a vertical ring high gradient magnetic separator. An upper magnetic yoke 2 and a lower magnetic yoke 3 are mounted on an upper portion of the machine frame 1. Two bearing seats of a rotary ring 4 are mounted on the upper magnetic yoke 2, and a ring body of the rotary ring 4 is located between the upper magnetic yoke 2 and the lower magnetic yoke 3. An ore feeding bucket 5, a water flushing bucket 6 and a concentrate collection apparatus 7 are provided in an internal space between two sides of the ring body, and a medium box 8 is provided at the periphery of the rotary ring 4. During the continuous rotation of the rotary ring 4, the medium box 8 is continuously brought into the ore slurry between the upper magnetic yoke 2 and the lower magnetic yoke 3 to adsorb magnetic particles.

After rotary ring 4 brings the magnetic medium immerged in the ore slurry to leave the ore slurry and rotates by a certain angle, pressure water provided at the top of the rotary ring flushes the magnetic mineral particles into a concentrate collection apparatus 7 to achieve the separation of materials.

A tailings box 9 is provided at a lower portion of the machine frame 1, a liquid level of the ore slurry in the tailings box 9 continuously fluctuates up and down under the action of a pulsating box 10, so as to achieve the flushing of the particles absorbed in the medium box 8, thereby improving the concentrate grade.

Figure 3:
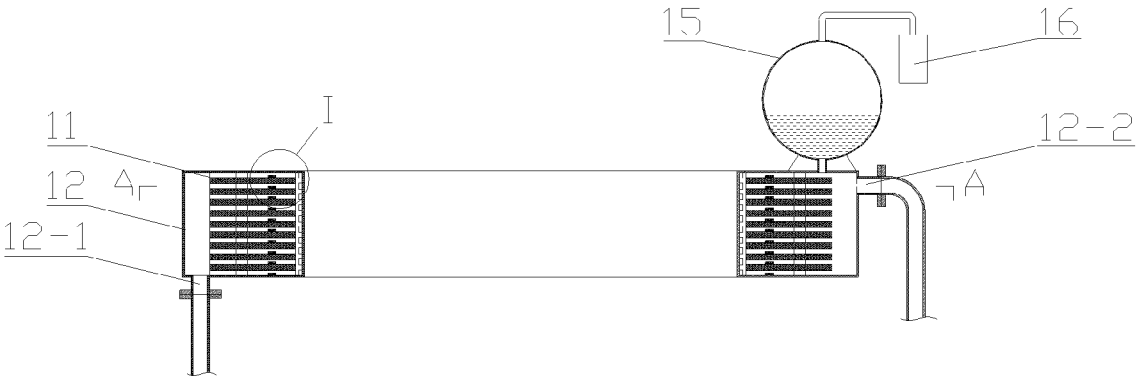
FIG. 3 is a full sectional schematic view of the winding coil and a coil casing shown in FIG. 1.
Figure 4:
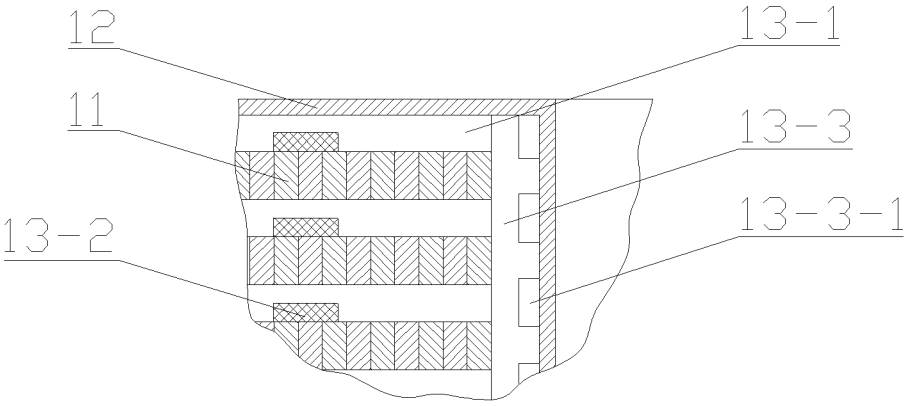
FIG. 4 is a partial enlarged schematic view of part I in FIG. 3.
Figure 5:
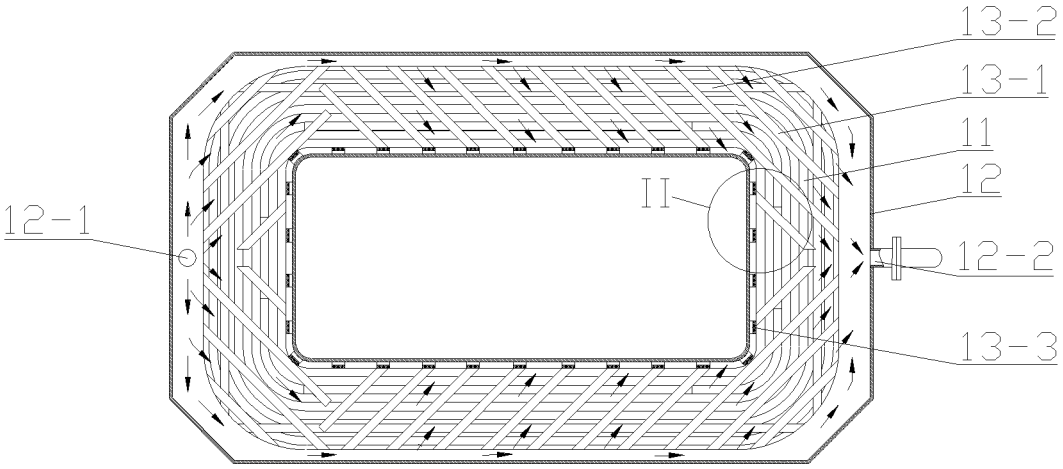
FIG. 5 is a schematic view taken along line A-A of FIG. 3.
Figure 6:
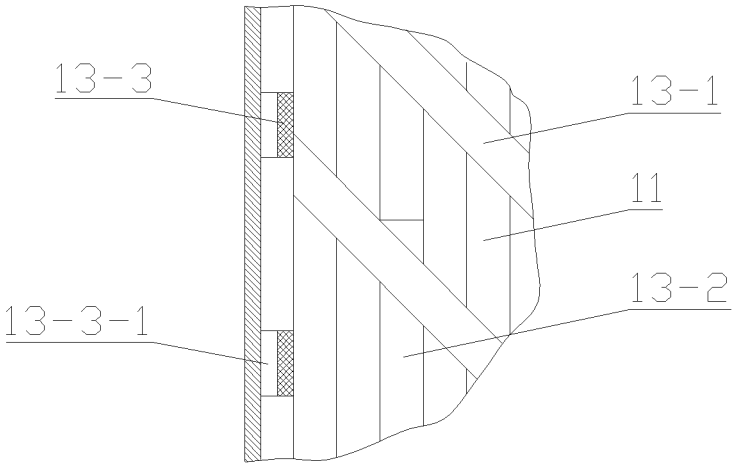
FIG. 6 is a partial enlarged schematic view of part II in FIG. 5.

Reference is made to FIGS. 3 to 6. FIG. 3 is a full sectional schematic view of the winding coil and a coil casing shown in FIG. 1; FIG. 4 is a partial enlarged schematic view of part I in FIG. 3; FIG. 5 is a schematic view taken along line A-A of FIG. 3; and FIG. 6 is a partial enlarged schematic view of part II in FIG. 5.

As shown in figures, an exciting winding coil 11 is surroundingly mounted on a magnetic pole, having an inner arc, of the lower magnetic yoke 3. The winding coil 11 is of a rectangular annular structure and is mounted in a hermetic coil casing 12, the coil casing 12 is made of a non-magnetic material, and the winding coil 11 is immerged in cooling oil (or other insulating coolant) in the coil casing 12. An oil inlet 12-1 and an oil outlet 12-2 are provided at middle portions of two ends of the coil casing 12, and the coil casing 12 is connected to an external cooling apparatus through pipes, so that the cooling apparatus can cool the cooling oil.

The winding coil 11 is of a multi-layer structure, an insulating member is provided between each layer of the winding coil to form gaps through which the cooling oil can pass. The insulating member includes first insulating pad strips 13-1, the first insulating pad strips 13-1 between each layer of the winding coil is arranged inclinedly with respect to a flow direction of the cooling oil and are spaced apart from each other.

Specifically (see FIG. 5), the first insulating pad strips 13-1 are symmetrically distributed along a connecting line between the oil inlet 12-1 and the oil outlet 12-1. Taking the first insulating pad strips 13-1 located at an upper side as an example, firstly, the first insulating pad strips 13-1 are arranged inclinedly upwardly from the oil inlet 12-1 with respect to the flow direction of the cooling oil and are parallel to each other; and after turning, the first insulating pad strips 13-1 are arranged inclinedly from an outer side of the winding coil toward an inner side of the winding coil with respect to the flow direction of the cooling oil and are parallel to each other, until reaching the oil outlet 12-2.

Except for the turning portion of the coil, an included angle between each of the first insulating pad strips 13-1 and conducting wires of the winding coil 11 is generally between 35°-70°, and normally it can be designed as 45°.

Since the first insulating pad strips 13-1 are arranged inclinedly with respect to the flow direction of the cooling oil and are spaced apart from each other, a plurality of relatively independent cooling oil channels may be formed between each layer of the winding coil such that the cooling oil can flow through the winding coil 11 along the channels without generating turbulent flow. In addition, the inclined arrangement can reduce the resistance for the cooling oil on one hand, such that the cooling oil can flow through the winding coils 11 smoothly, and can obtain a longer channel length on the other hand, such that the cooling oil and the winding coil 11 may be in contact with each other sufficiently to exchange heat.

It should be noted that, the first insulating pad strips 13-1 being arranged inclinedly with respect to the flow direction of cooling oil and being spaced apart from each other is only one embodiment. According to actual needs, the first insulating pad strips 13-1 can also be arranged vertically with respect to the flow direction of cooling oil and are spaced apart from each other, i.e. the extending direction of the first insulating pad strips 13-1 is maintained perpendicular to the extending direction of the conducting wires of the winding coil, gaps through which the cooling oil can pass can also be formed between the winding coil.

Figure 7:
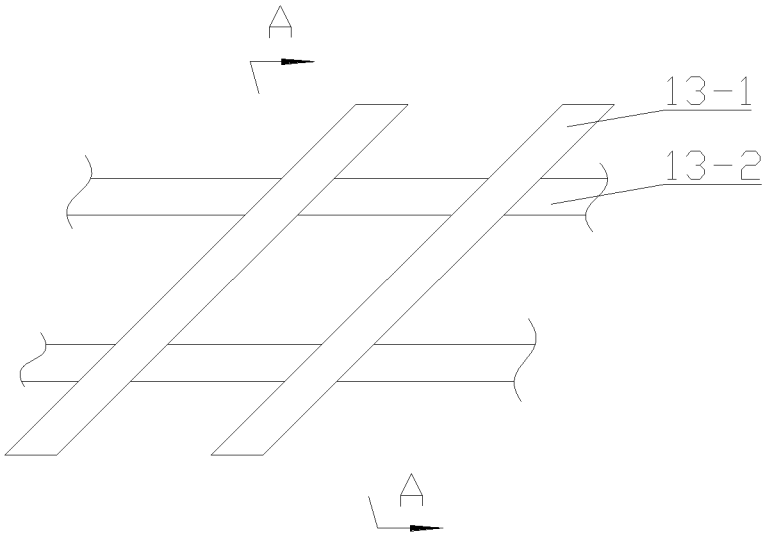
FIG. 7 is a partial schematic view showing the connection between first insulating pad strips and second insulating pad strips.
Figure 8:
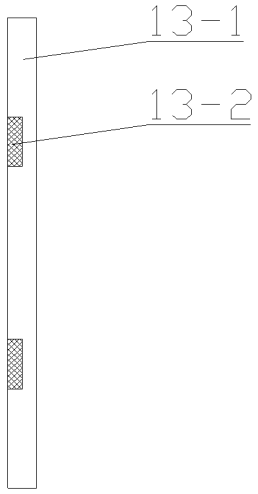
FIG. 8 is a schematic view taken along line A-A of FIG. 7.

Reference is made to FIGS. 7 and 8. FIG. 7 is a partial schematic view showing the connection between first insulating pad strips and second insulating pad strips; and FIG. 8 is a schematic view taken along line A-A of FIG. 7.

For preventing the first insulating pad strips 13-1 from moving in use, second insulating pad strips 13-2 may be further provided. One or a plurality of notches, matching a sectional shape of the second insulating pad strips 13-2, are provided at a bottom of each of the first insulating pad strips 13-1. The second insulating pad strips 13-2 are arranged substantially along the flow direction of the cooling oil. The second insulating pad strips 13-2 are arranged intersecting with the first insulating pad strips 13-1 and are embedded in the notches of the first insulating pad strips 13-1 such that the first insulating pad strips 13-1 are connected integrally, and the first insulating pad strips 13-1 and the second insulating pad strips 13-2 intersect with each other to form a net structure so as to effectively fix the first insulating pad strips 13-1, thereby preventing failure caused by the moving of the first insulating pad strips 13-1.

The length of each of the second insulating pad strips 13-2 is determined according to the number of the first insulating pad strips 13-1 to be connected by each of the second insulating pad strips 13-2. Here, a short second insulating pad strip 13-2 and a long second insulating pad strip 13-2 are provided at each side of the rectangular winding coil 11, and a thickness of each of the second insulating pad strips 13-2 is less than (or equal to) a depth of each of the notches of the first insulating pad strips 13-1 so as to ensure the integrity of channels formed by the first insulating pad strips 13-1 spaced apart from each other, thereby preventing the channels from being communicated with each other to form turbulent flow.

As an ideal solution, the first insulating pad strips 13-1 and the second insulating pad strips 13-2 may be formed integrally. Of course, without considering the turbulent flow, the first insulating pad strips 13-1 and the second insulating pad strips 13-2 can also be directly stacked together or can be connected with each other by bonding or bundling.

Figure 9:
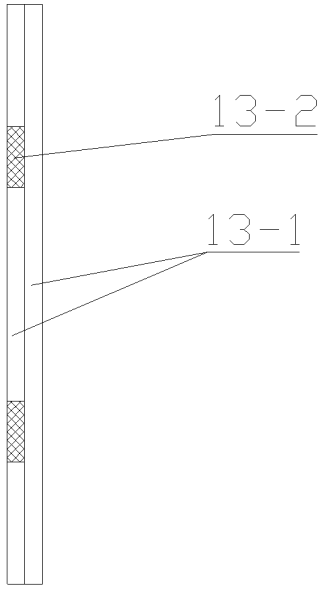
FIG. 9 is a sectional view showing another connection between the first insulating pad strips and the second insulating pad strips.

Reference is made to FIG. 9. FIG. 9 is a sectional view showing another connection between the first insulating pad strips and the second insulating pad strips.

The first insulating pad strips 13-1 are of a double-layer (or multi-layer) structure, and each of the layers are bonded together, wherein a layer, intersecting with the second insulating layer pad strips 13-2, of each of the first insulating pad strips 13-1 includes multiple segments, and a space between adjacent segments forms each of the notches. In this way, a process for forming notches on the first insulating pad strips 13-1 is omitted, thereby further reducing the manufacturing difficulty.

Reference is made to FIG. 4 and FIG. 6 again. FIG. 4 is a partial enlarged schematic view of part I in FIG. 3; and FIG. 6 is a partial enlarged schematic view of part II in FIG. 5.

Third insulating pad strips 13-3 are vertically provided between an inner side of the winding coil 11 and an annular inner wall of the coil casing 12 and are spaced apart from each other. The third insulating pad strips 13-3 are fixed to the annular inner wall of the coil casing 12, and liquid guiding notches 13-3-1 spaced apart from each other are provided on a side, close to the annular inner wall, of each of the third insulating pad strips 13-3.

Thus, after entering into an oil inletting chamber of the coil casing 12 via the oil inlet 12-1 and flowing inclinedly through the gaps between the layers of the winding coil 11, the cooling oil can flow to an oil returning chamber smoothly via the liquid guiding notches 13-3-1 of the third insulating pad strips 13-3.

When the vertical ring high gradient magnetic separator is in operation, after entering into the coil casing 12 via the oil inlet 12-1, the cooling oil can flow between each layer or a plurality of layers of the winding coil, so that the contact area between the cooling oil and the winding coil 11 multiplies. The cooling oil may be in contact with the winding coil 11 at different positions sufficiently to exchange heat, and then the cooling oil carrying the heat flows toward the oil outlet 12-2 along the gaps so as to take away the heat generated by the winding coil 11, this rapid heat dissipation capability can ensure the winding coil 11 maintaining a lower temperature during operation, thereby obtaining a higher magnetic field strength.

Figure 10:
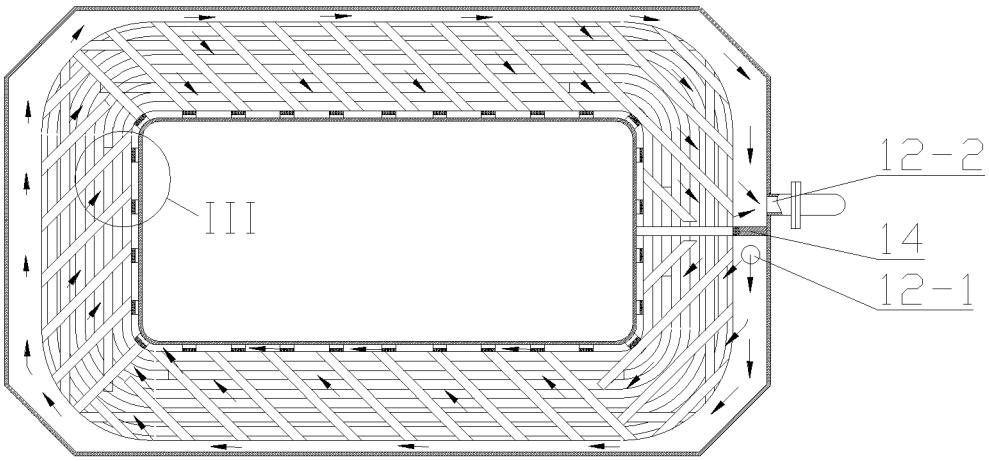
FIG. 10 is a top view of another winding coil and another coil casing.
Figure 11:
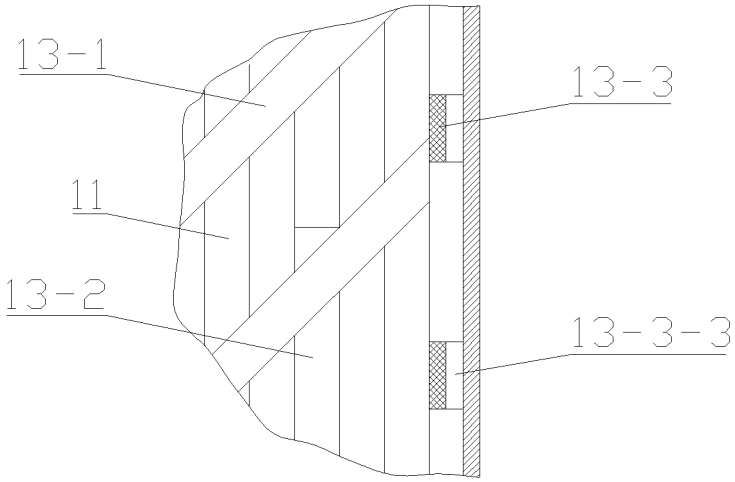
FIG. 11 is a partial enlarged schematic view of part III in FIG. 10.

Reference is made to FIGS. 10 and 11. FIG. 10 is a top view of another winding coil and another coil casing; and FIG. 11 is a partial enlarged schematic view of part III in FIG. 10.

In another embodiment, the oil inlet 12-1 and the oil outlet 12-2 of the coil casing 12 are located at a same end of the coil casing 12, a baffle 14 is provided inside the coil casing 12 to separate the oil inlet 12-1 from the oil outlet 12-2, and the baffle 14 is fixedly connected to the coil casing 12, and a rubber strip (not shown) is provided at a portion, jointing with the winding coil 11, of the baffle 14.

Unlike the first embodiment, in this embodiment, after entering into the coil casing 12, the cooling oil flows to the oil outlet 12-2 after flowing around the cooling oil, instead of flowing to the oil outlet 12-2 from two sides of the winding coil 11. Therefore, the first insulating pad strips 13-1 are of a non-symmetrical structure and are arranged inclinedly in a clockwise manner with respect to the flow direction of the cooling oil, and other structures are the same as those in the first embodiment, which can refer to the above description.

For preventing oil overflowing or oil shortage of the cooling oil when expanding with heat or contracting with cold, an oil compensating tank 15 in communication with the coil casing 12 is provided at an upper portion of the coil casing 12. The oil compensating tank 15 can compensate oil at any time according to different temperatures of the cooling oil in the circulation system so as to ensure the circulation system having sufficient cooling oil.

A breather 16 in communication with a casing of the oil compensating tank 15 is mounted on the oil compensating tank 15, materials for preventing entering of moist air is provided in the breather 16. When the oil increases or decreases, the breather 16 mounted on the oil compensating tank 15 can filter the air entering into the oil compensating tank at any time, so as to prevent the air containing water from entering into the cooling oil, thereby ensuring the winding coil 11 having a higher insulating property.

The conducting wire of the wire winding coil 11 can be a solid copper wire, an aluminum wire or wires made of other materials. The cross-section of the conducting wire can be rectangular or other shapes, and an external surface of the conducting wire is covered with a high-temperature resistant insulating material.

The above vertical ring high gradient magnetic separator is only one embodiment, the specific structure thereof is not limited to the above description, and various embodiments can be obtained by making specific adjustments on the basis of the above embodiment according to actual needs. For example, a plurality of layers of the winding coil 11 can form one group, the insulating member is provided between each group to form gaps through which the cooling oil may pass, or the insulating member can be provided in a manner of combing one layer and a plurality of layers. There are many implementation manners, which will not be illustrated herein.

The vertical ring high gradient magnetic separator provide by the present application is described in detail hereinabove. The principle and the embodiments of the present application are illustrated herein by specific examples. The above description of examples is only intended to help the understanding of the spirit of the present application. It should be noted that, for the person skilled in the art, many modifications and improvements may be made to the present application without departing from the principle of the present application, and these modifications and improvements are also deemed to fall into the protection scope of the present application defined by the claims.

The invention claimed is:

1. A vertical ring high gradient magnetic separator, comprising an exciting winding coil and a coil casing, the winding coil being immerged in coolant in the coil casing, wherein the winding coil is of a multi-layer structure, and an insulating member is provided between each layer or a plurality of layers of the winding coil to form gaps through which the coolant passes; and wherein the insulating member comprises first insulating pad strips located between each layer or a plurality of layers of the winding coil, which are arranged inclinedly with respect to a flow direction of the coolant and are spaced apart from each other.

2. The vertical ring high gradient magnetic separator according to claim 1, further comprising second insulating pad strips connecting the first insulating pad strips, the second insulating pad strips are arranged intersecting with the first insulating pad strips and are embedded in notches of the first insulating pad strips.

3. The vertical ring high gradient magnetic separator according to claim 2, wherein the second insulating pad strips are arranged along the flow direction of the coolant and each have a thickness less than or equal to a depth of each of the notches of the first insulating pad strips.

4. The vertical ring high gradient magnetic separator according to claim 2, wherein the first insulating pad strips are of a double-layer structure or a multi-layer structure, a layer, intersecting with the second insulating pad strips, of each of the first insulating pad strips is of a multi-segment structure, and a space between adjacent segments of the layer forms each of the notches.

5. The vertical ring high gradient magnetic separator according to claim 2, wherein third insulating pad strips are vertically provided between an inner side of the winding coil and an annular inner wall of the coil casing and are spaced apart from each other, and liquid guiding notches spaced apart from each other are provided on a side, close to the annular inner wall, of each of the third insulating pad strips.

6. The vertical ring high gradient magnetic separator according to claim 5, wherein the third insulating pad strips are fixed to the annular inner wall.

7. The vertical ring high gradient magnetic separator according to claim 1, wherein a liquid inlet and a liquid outlet of the coil casing are located at two ends of the coil casing respectively.

8. The vertical ring high gradient magnetic separator according to claim 1, wherein a liquid inlet and a liquid outlet of the coil casing are located at a same end of the coil casing, and a baffle is provided inside the coil casing for separating the liquid inlet from the liquid outlet.

9. The vertical ring high gradient magnetic separator according to claim 1, wherein a liquid compensating tank in communication with the coil casing is mounted at an upper portion of the coil casing and a moisture-proof breather is mounted at an air inlet of the liquid compensating tank.

* * * * *